US006679957B1

(12) United States Patent
Barteri et al.

(10) Patent No.: US 6,679,957 B1
(45) Date of Patent: Jan. 20, 2004

(54) PROCESS FOR THERMAL TREATMENT OF STEEL STRIP

(75) Inventors: Massimo Barteri, Rome (IT); Sandro Fortunati, Terni (IT); Gianni Songini, Terni (IT)

(73) Assignee: Acciai Speciali S.p.A., Terni (IT)

( * ) Notice: Subject to any disclaimer, the term of this patent is extended or adjusted under 35 U.S.C. 154(b) by 0 days.

(21) Appl. No.: 09/787,313

(22) PCT Filed: Sep. 15, 1999

(86) PCT No.: PCT/EP99/06814

§ 371 (c)(1),
(2), (4) Date: May 17, 2001

(87) PCT Pub. No.: WO00/15854

PCT Pub. Date: Mar. 23, 2000

(30) Foreign Application Priority Data

Sep. 15, 1998 (IT) ..... RM98A0592

(51) Int. Cl.[7] ..... C21D 8/00; C21D 9/52

(52) U.S. Cl. ..... 148/601; 148/602

(58) Field of Search ..... 148/601, 602

(56) References Cited

FOREIGN PATENT DOCUMENTS

JP 359113121 A * 6/1984 ..... C21D/8/02

* cited by examiner

*Primary Examiner*—Deborah Yee
(74) *Attorney, Agent, or Firm*—Abelman, Frayne & Schwab

(57) ABSTRACT

In the thermal treatment of continuous-cast or hot-rolled steel strip, by using particular solutions regarding the choice of the strip rolling temperatures, the transfer times from the coiler to the furnace, as well as specific process steps in annealing, it is possible to treat any type of steel by sending the coils of strip, still at a high temperature, directly to the annealing furnace, at the same time maintaining the mechanical and microstructural characteristics obtainable in traditional cold-strip annealing.

19 Claims, No Drawings

PROCESS FOR THERMAL TREATMENT OF STEEL STRIP

SCOPE OF INVENTION

The present invention refers to a process for the thermal treatment of steel strip and, more precisely, refers to the thermal treatment both of as cast steel strip using the so-called strip-casting technique, and of hot-rolled strip. The process is moreover suited for the treatment of any type of steel.

STATE OF THE ART

Normally, steel strip, either directly continuously cast or hot-rolled, is wound, when it is still at a high temperature, in coils which are left to cool down at room temperature. However, as is well known to those skilled in the field, the strips thus rolled do not possess characteristics suitable for a subsequent cold-rolling treatment, in particular as regards their microstructure, homogeneity of composition, and their mechanical characteristics. Consequently, it is necessary to bring the coils to a high temperature for a time sufficient for bringing about the necessary changes, with a treatment referred to as annealing.

Annealing may be either of the continuous type or of the discontinuous type. Continuous annealing is carried out in a furnace heated at a high temperature, through which the strip is made to pass at a certain speed. Continuous annealing permits a uniform quality of the treated strip and a limited treatment time, but entails large and costly plants.

In discontinuous annealing, the strip is wound into coils, which are then loaded into a furnace. In this case, the plant is simple, not particularly cumbersome, and relatively economical, but the process of treatment is very long, generally in the region of a few dozen hours, and the end quality of the product is uneven.

For the treatment of strip that is directly continuously cast or hot-rolled, the annealing method most widely used is the discontinuous one, which presents evident disadvantages in terms of waste of energy, time and resources, and the resulting quality is not uniform.

A possible solution to the problems referred to above may be that of transporting the coils from the winding stage to the annealing furnace without allowing them to cool down excessively.

In this connection, so far attention has been focused on the treatment of stainless steels, or in any case corrosion-resistant steels. For example, the published Japanese patent application No. 52-65126 describes a process for the thermal treatment of stainless steels (of the types SUS 410 and SUS 430), in which the stainless-steel coils are loaded still hot into the annealing fumace. Likewise, the European patent application No. 343 008 refers to the treatment of hot-rolled stainless-steel strip, or in any case corrosion-resistant strip, in which the strip is hot-rolled above the transformation temperature A3 and then cooled down at a rate of between 10 and 1 ° C./min, in order to prevent the presence of martensite. This is obtained by isolating the strip against excessive heat losses, at least in part enclosing it in a thermally insulated casing.

The experience acquired through long experiments carried out by the present applicant has revealed that the teaching that may be drawn from the known art does not appear satisfactory, in particular for strip of small thickness, for example less than 3 mm. Furthermore, the known art is declaredly applicable only to stainless steels, or in any case corrosion-resistant steels. In addition to these points, the applicant has identified a number of process parameters not taken into consideration by the known art, which appear essential in order to achieve high-quality results.

The purpose of the present invention is, therefore, to enable hot treatment of steels of any type, cast directly in continuous casting or hot-rolled, in particular to small thicknesses, to obtain in the treated strip an excellent uniformity of composition and microstructure, in particular the absence of martensite, and hence high and uniform mechanical properties, not inferior to those obtainable from traditional annealing processes.

Amongst the advantages of the present invention, which are obvious to those skilled in the field, we recall that of an important energy saving.

DESCRIPTION OF THE INVENTION

According to the present invention, the process for thermal treatment of strip, in particular strip of small thickness, of any type of steel, in particular carbon-manganese steels or carbon steels alloyed with nickel and/or chrome and/or molybdenum, non-oriented-grain silicon magnetic steels, and stainless steels, wound on coils when still at a high temperature, is characterized by the combination in a co-operation relationship, of the following steps: (i) winding of the strip at a temperature of between 600° C. and the transformation temperature A3; (ii) transfer of the coils into an annealing furnace in a time of less than 30 minutes from winding, preferably less than 20 minutes, the furnace being heated to a temperature of between 560 and 870° C. and maintaining the pre-selected temperature of steel for a pre-selected time; (iii) taking the coils out of the furnace at a temperature of less than 650° C.

The temperature to which the furnace is to be heated depends upon the type of steel that is being treated and, in particular, in the case of stainless steels is between 650 and 850° C., preferably between 800 and 850° C.; for carbon steels it is between 570 and 760° C., preferably between 670 and 730° C.; for non-oriented-grain magnetic steels, it is between 660 and 830° C., preferably between 670 and 710° C.

Since according to the present invention it is possible to treat any type of steel, we shall now give the winding temperatures necessary for three important types of steel, i.e., carbon steels, non-oriented-grain magnetic steels, and stainless steels. For carbon steels, the coil winding temperature is between 600 and 770° C., preferably between 700 and 750° C.; for non-oriented-grain magnetic steels, the coil winding temperature is between 700 and 850° C.; and for stainless steels, the coil winding temperature is between 650 and 850° C.

In addition, according to the present invention it is possible to anneal the steel according to any one of the possible ways, and namely, passive annealing, in which the hot coil is charged into the furnace heated to a high temperature, the heat tranfer to the furnace after charging the coils being negligible or zero, so that the temperature of the furnace, and hence of the strip, slowly decreases in time; isothermal annealing, in which, after charging the coils into the fumace, the temperature of the furnace is kept at a desired level for a pre-set time, after which the temperature of the coils slowly decreases in time; and total annealing, in which after charging the coils into the furnace, the temperature of the furnace and hence of the coils is raised for a given period of time, until a pre-selected value is reached, after which the furnace and the coils are left to cool down slowly. In any case, the coils are taken out of the furnace at a given temperature, as will be seen later.

Consequently, in the case of passive annealing, the heating temperature of the furnace is between 600 and 860° C., according to the type of steel, and the strip is kept at this temperature for less than 30 min, after which the furnace and strip are left to cool down for 8–28 hours, to obtain a maximum temperature of the strip, when it is taken out of the furnace, of less than 520° C.

In the case of isothermal annealing, instead, the heating temperature of the furnace is between 580 and 830° C., according to the type of steel, the coils being kept at this temperature for 4–15 hours, after which the furnace and strip are left to cool down for 4–16 hours, to obtain a maximum temperature of the strip, when it is taken out of the furnace, of less than 650° C.

Finally, in the case of total annealing, the furnace is heated at a temperature of between 600 and 850° C., according to the type of steel, the coils being kept at this temperature for 4–15 hours, after which the furnace and strip are left to cool down for 4–16 hours, to obtain a maximum temperature of the strip, when it is taken out of the furnace, of less than 650° C.

It has moreover been found that the effectiveness of the process according to the present invention is improved if the coils are put into the furnace in a horizontal position. The improvement obtained is due, according to some experimental data, to the fact that, with the coils arranged in this way, circulation of the atmosphere inside the hole present around the axis of the coils is enhanced, so favouring a better uniformity of the thermal gradient along the radius of the coils themselves.

EXAMPLES

Stainless Steel

Strips of stainless steel AISI 430, both continuously cast and hot-rolled to a thickness of 3.0 mm, were wound in coils at a temperature of 840° C. and transferred to an annealing furnace within 15 minutes from the end of winding. In the case of passive annealing, the temperature of the furnace was 840° C., and the coils put in the furnace remained there for 24 hours and were subsequently taken out at a temperature of approximately 500° C. and left to cool off in air.

In the case of isothermal annealing, the furnace was pre-heated to a temperature of 820° C., and the coils were kept at this temperature for approximately 12 hours. The furnace was then turned off and left to cool down spontaneously for 22 hours, and the coils were then taken out of the furnace at a temperature of approximately 500° C. and left to cool off in air.

In the case of total annealing, i.e., with temperature rising, the coils, which were put in the furnace when the latter was already hot, were heated again at the winding temperature (840° C.) and left at this temperature for 12 hours, after which the furnace was turned off and the coils were left to cool down at a cooling rate of approximately 15° C./h, and were then taken but of the furnace at a temperature of approximately 640° C. and left to cool off in air.

Table 1 below gives the mechanical characteristics measured on the steels obtained in the tests described above, cold-rolled to 0.6 mm and annealed, as well as the results obtained from conventional static annealing.

In this table, by "Rp0.2" is meant the load necessary to obtain an irreversible deformation of 0.2% in the original length of the test specimen; by "Rm" is meant the breaking load of the specimen; and by "% el." is meant the permanent percentage elongation of the test specimen at failure.

TABLE 1

| | Rp0,2 (MPa) | Rm (MPa) | % el. |
|---|---|---|---|
| Passive annealing | 346 ± 23 | 506 ± 20 | 27.5 ± 1.7 |
| Isothermal annealing | 327 ± 23 | 500 ± 15 | 27.5 ± 2.1 |
| Total annealing | 338 ± 23 | 524 ± 17 | 26.8 ± 1.2 |
| Traditional annealing | 330 ± 20 | 520 ± 20 | 27.0 ± 2.0 |

As may be seen, the characteristics of the steels treated according to the present invention are perfectly in line with those obtained with traditional annealing.

Non-oriented-grain Magnetic Steels

Strips of steel containing 1% silicon, of the classes with improved permeability, for which annealing of the hot strip is already known in the art, were treated.

The strips were wound at a temperature of between 700 and 780° C. and transferred within 13 minutes into a furnace, pre-heated to a temperature of between 680 and 700° C. The time during which the strips were kept in the furnace, for isothermal annealing, was between 2 and 6 hours. In this way, it was possible to maximize the intensity of the texture (001) [100] and to minimize the texture <111>, so obtaining peak permeability consistently higher than 2440 gauss/oersted in the finished product, for which the traditional permeability values are between 2300 and 2500 gauss/oersted.

Carbon Steels

Strips of carbon steel of the types C70 and 35CD4, both continuously cast and hot-rolled, were isothermally annealed.

For the C70 steel, the strips were wound at a temperature of 700–720° C. and transferred to the furnace, which had been pre-heated to approximately 720° C. The coils were kept in the furnace for between 2 and 4 hours at a temperature of approximately 700° C., allowed to cool down to 630° C., and then taken out of the furnace and left to cool off in air. The final structure obtained was approximately 85–90% fine perlite. The mechanical characteristics obtained were altogether similar to those obtained with traditional annealing methods, either static or continuous.

For the 35CD4 steel, the strips were wound at a temperature of 720–740° C. and then transferred to the furnace, which had been pre-heated to approximately 730 ° C. The coils were kept in the furnace for between 3 and 5 hours at a temperature of approximately 720° C., allowed to cool down to 620° C., and then taken out of the furnace and left to cool off in air. The final structure obtained was fine perlite. The mechanical characteristics obtained were altogether similar to those obtained with traditional annealing methods, either static or continuous.

What is claimed is:

1. A process for the treatment of high temperature coiled steel strip of any type, comprising the following steps: (i) winding of the strip at a temperature from above 600° C. to the transformation temperature A3; (ii) transferring the coils in an annealing furnace within less than 30 minutes from winding, the furnace being heated to a temperature of between 560° C. and 870° C., and maintaining them at a pre-chosen temperature for a pre-selected time; (iii) taking the coils out of the furnace at a temperature lower than 650° C.

2. Process according to claim 1, wherein for stainless steels the heating temperature of the furnace is between 650 and 850° C.

3. Process according to claim 2, wherein the heating temperature of the furnace is between 800 and 850° C.

4. Process according to claim 1, wherein for carbon steels the heating temperature of the furnace is between 570 and 760°.

5. Process according to claim 4, wherein the heating temperature of the furnace is between 670 and 730° C.

6. Process according to claim 1, wherein for non-oriented-grain magnetic steels the heating temperature of the furnace is between 660 and 830° C.

7. Process according to claim 6, wherein the heating temperature of the furnace is between 670° C. and 710° C.

8. Process according to claim 1, wherein for carbon steels the temperature of winding in coils is between 600 and 750° C.

9. Process according to claim 8, wherein the temperature of winding is between 700 and 750° C.

10. Process according to claim 1, wherein for non-oriented-grain magnetic steels the temperature of winding in coils is between 700 and 850° C.

11. Process according to claim 1, wherein for stainless steels the temperature of winding in coils is between 650 and 850° C.

12. Process according to claim 1, wherein the time for transferring the coil from the winding station to the annealing furnace is less than 20 min.

13. Process according to claim 1, wherein in the case of passive annealing, the heating temperature of the furnace is between 600° C. and 860° C., and the strip is kept at this temperature for less than 30 min. after which the furnace and strip are left to cool down for 8 to 28 hours, to obtain a maximum strip temperature when the strip is taken out of the furnace of between 4500 and 550° C.

14. Process according to claim 1, wherein in the case of isothermal annealing, the heating temperature of the furnace is between 580° C. and 830° C., the coils being kept at this temperature for 4 to 15 hours, after which the furnace and strip are left to cool down for 4 to 16 hours, to obtain a maximum strip temperature when the strip is taken out of the furnace lower than 650° C.

15. Process according to claim 1, wherein in the case of total annealing, the furnace is heated at a temperature of between 600 and 850° C., the coils being kept at this temperature for 4–15 hours, after which the furnace and strip are left to cool down for 4–16 hours, to obtain a maximum strip temperature when the strip is taken out of the furnace lower than 650° C., the strip then being left to cool off in the air.

16. Process according to claim 1, wherein the coils are set in the furnace in a horizontal position.

17. Process according to claim 4, wherein for carbon steels the temperature of winding in coils is from above 600° C. to 750° C.

18. Process according to claim 6, wherein for non-oriented grain magnetic steels the temperature of winding in coils is between 700° C. and 850° C.

19. Process according to claim 2, wherein for stainless steels the temperature of winding in coils is between 650° C. and 850° C.

* * * * *